United States Patent [19]

Naidenov et al.

[11] Patent Number: 4,872,118

[45] Date of Patent: Oct. 3, 1989

[54] SYSTEM FOR AUTOMATED MONITORING OF TRIM AND STABILITY OF A VESSEL

[76] Inventors: Evgeny V. Naidenov, Naberezhnaya Fontanki, 24, kv. 78, Leningrad; Georgy I. Belozerov, Shestnadtsataya Parkonaya ulitsa, 19, korpus 2, kv. 146, Moscow; Viktor E. Salov, ulitsa Rudneva, 21 korpus 1, kv. 140, Leningrad; Ivan V. Zakharov, ulitsa Marata, 8, kv. 2, Leningrad, all of U.S.S.R.

[21] Appl. No.: 120,429

[22] Filed: Nov. 13, 1987

Related U.S. Application Data

[63] Continuation-in-part of Ser. No. 639,020, Aug. 9, 1984, abandoned.

[51] Int. Cl.[4] ..... G06F 15/20; B63B 43/04

[52] U.S. Cl. ..... 364/463; 114/124; 318/588

[58] Field of Search ..... 364/424.01, 463; 114/124, 125; 318/588

[56] References Cited

U.S. PATENT DOCUMENTS

| | | | |
|---|---|---|---|
| 2,915,109 | 10/1975 | Martin et al. | 114/125 |
| 3,128,375 | 4/1964 | Grimnes | 364/424.01 |
| 3,917,937 | 11/1975 | Sten | 364/463 |
| 3,968,353 | 7/1976 | Küller | 114/125 |
| 4,524,710 | 6/1985 | Scott | 318/588 |
| 4,549,267 | 10/1985 | Drabouski, Jr. | 364/463 |
| 4,647,928 | 3/1987 | Casey et al. | 364/463 |

OTHER PUBLICATIONS

"Navigator's Library", E. V. Naidenov, Monitoring Trim and Stability of Ship, Transport Publishers, Moscow, 1983, pp. 111–113, 115–121, and English translation.

*Primary Examiner*—Gary Chin

*Attorney, Agent, or Firm*—Lilling & Greenspan

[57] ABSTRACT

A system for automated controlling of the trim and stability of a vessel includes sensors for monitoring the value of the draft of the vessel, a sensor of the heel angle of the vessel and a heeling subsystem connected to a signal conditioner connected, in its turn, through an interface to a computer, a heel angle transducer connected with a comparator also connected with a unit for presetting the value of heeling of the vessel and with a switching unit connected with the heeling subsystem.

6 Claims, 5 Drawing Sheets

SYSTEM FOR AUTOMATED MONITORING OF TRIM AND STABILITY OF A VESSEL

CROSS REFERENCE TO RELATED APPLICATIONS

The present Application is a continuation-in-part of U.S. patent application Ser. No. 639,020 filed on Aug. 9, 1984.

BACKGROUND OF THE INVENTION

1. Field of the Invention

The invention relates to means for monitoring seagoing characteristics of a vessel or ship, and more particularly it relates to systems for automated monitoring of the trim and stability of a vessel.

The invention can be utilizd on ships of all kinds having displacement of at least one thousand register tons, such as tankers, timber carriers, container carriers, ships of the ro-ro and ro-flow types, ore and bulk cargo carriers, on fishing trawlers and offshore platforms.

It is generally known that in order to ensure safe sailing, the crew of a ship has to be aware of the performance characteristics of the ship at any given moment, e.g. the ship's seagoing and strength characteristics, as well as of the current situation in the complex vessel-cargo-environment dynamic system, particularly, in emergencies that may eventually arise in everyday service.

2. Description of the Prior Art

There are known various systems for monitoring the trim, stability and general strength of a vessel.

Thus, there are systems for monitoring the general strength of a vessel based on evaluation of the general bending moment and of the shearing forces or strain produced by general bending of the vessel's hull.

One of the known systems (installed on M/V "Olympic Challenge"; 65,000 ton dwt) comprises a projector mounted amidships and directing a light pencil onto a mirror accommodated on the aft super-structure. The reflected beam is sent by the mirror onto a photocell arranged adjacent to the projector. Should the reflected beam deflect, the photocell initiates a signal sent to a mechanism for rotating the mirror, so as to return the beam to its home position. The angle of rotation of the mirror serves as the output signal of the ship sag sensor. However, as bending moments and shearing forces are different at various sections of the ship's hull, the abovedescribed technique would not yield adequately accurate results.

There is further known a strength monitoring system acting on the same principle as the one described above. This system is operable for determining the bending moments and shearing forces from the values of the draft of the ship measured at several sections. This system is even less accurate on account of imperfection of available draft sensors, as their absolute error in measuring the draft more often than not is as great as the maximum sag of the ship. Moreover, the two abovementioned systems do not monitor the stability of a ship.

Furthermore, there are known systems for monitoring the general strength of a ship based on direct measurements of strain in the ship's hull with the use of strain gauge sensors (cf. "Wedar" system developed in Norway). The system is intended for measuring the wave impact load at sea. The external load is varied by altering the ship's course and speed. The system includes the starboard and port deck-mounted sensors measuring the total strain induced by the bending moment amidships, a bow accelerometer measuring vertical motion of the ship, an electronic amplification device and a unit for processing the values being measured situated in the wheelhouse, and various alarms. When the strain level reaches a threshold value, a warning signal is generated. The system fails completely to monitor the trim and stability characteristics; moreover, various design deficiencies of the system's hardware have resulted in its limited use.

There is still further known a system for monitoring the trim and stability of a vessel (E. V. Naidenov, "Kontrol posadki i ostoichivosti sudna", 1983, "Transport" (Moscow), pp. 111–112). To determine the draft values, two draft gauges of the hydrostatic type are mounted at the ship's bow and stern. To determine the metacentric height from a heeling test, it is necessary to know the inclining moment, the displacement of the ship and the heel angle increment which the ship attains due to the inclining moment applied thereto.

The "Intering" system provides solely for automatic heeling of the ship, i.e. for driving the ballast fluid into the heeling tank by a compressor.

The heeling moment value always remains constant (about 50–60 tm) depending on the type of the ship. The value of the increment of the heel angle is obtained from an inclination meter which is a common-type level gauge with a two-metre base. The accuracy of determination of an increment to the heel angle attainable with this instrument is about 0.1 arcuate degree. This known system is characterized by relatively low accuracy and the complicated procedure of determining the metacentric height. The low accuracy is caused by the system incorporating the inclination meter with 0.1 arcuate degree divisions and by the constancy of the heeling moment which, in case of a small metacentric height, can result in the ship's heel attaining the highly undesirable value up to 8° that may cause displacement of the ship's cargo, because in most cases the heeling procedure is carried out after cargo-handling operations, prior to the ship's departure or while securing the cargo; furthermore, heel angles of this magnitude reduce the accuracy of metacentric height computation. Thus, with a heel angle of 8° and a small metacentric height the relative error can be as high as 10 percent. With a great value of the metacentric height, on the other hand, the constant heeling moment causes a heel angle whose value is too low —as low as 0.3°–0.4°—and is commensurate with an error in measuring the heel angle increment. This causes considerable errors in computation of the metacentric height, as great as 25 percent. Therefore, employment of systems of the type being discussed, firstly, affects the economy of ship's operation when a computation error results in the metacentric height being unjustly evaluated too high, and, secondly, may even cause an emergency situation when the computation error drifts towards the minimum value of the metacentric height.

There is further known a system for automated monitoring of the trim and stability of a vessel (E. V. Naidenov, "Kontrol'posadki i ostoichivosti sudna", 1983, "Transport" (Moscow), pp. 115–121). The system comprises a sensor monitoring the value of the draft of the vessel, a heel angle sensor, a heeling subsystem with manually and automatically operated control valves and its power supply unit. The sensors are connected to a signal conditioner which is interconnected with a computer determining the value of the metacentric height. The operation of this system is characterized by the following. If the ship's stability is low, the operation of the system could cause a considerable list of the vessel which is intolerable in practice, whereas when the stability is high, the system fails to produce the necessary heeling of the ship, which increases the error in determining the metacentric height. Moreover, the system's response is not adequately quick.

When the heeling operations are conducted at sea, the accuracy of determining the displacement value is low on account of the absence of compensation for dynamic head of water. Neither does the system account for the influence of such factors as the trim difference and submerged depth. Besides, the system is devoid of facilities for monitoring the general strength of a vessel.

SUMMARY OF THE INVENTION

It is an object of the present invention to create a system for automated monitoring of the trim and stability of a vessel, which should provide for enhancing the accuracy of computation of the metacentric height of the vessel.

It is another object of the present invention to provide conditions for emergency-free operation of a vessel.

It is still another object of the present invention to create a system of automated monitoring of the trim and stability of a vessel, which should provide for enhancing the efficiency of operating the vessel by stepping up the amount of carried pay cargo and reducing the amount of extra ballast.

The essence of the invention resides in a system for automated control of the trim and stability of a vessel, comprising a signal conditioner, at least two sensors for monitoring the value of the draft of the vessel, mounted fore and aft of the vessel, at least one sensor of the vessel's heel angle, each of said sensors being connected to its respective group of inputs of the signal conditioner, a vessel heeling subsystem having its first and second outputs connected to their group of inputs of the signal conditioner, a computer adapted to compute the value of the metacentric height of the vessel, determining the stability of the vessel, and the values of the displacement and trim of the vessel from the signals coming from the sensors monitoring the value of the draft of the vessel, the heel angle sensor and the vessel heeling subsystem converted into a digital form in the signal conditioner to which the computer in electrically connected, first and second switching units adapted to switch on and off the system supply voltage; The system, in accordance with the present invention, comprises a unit for presetting the value of the heel of the vessel, a first comparator having the unit for presetting the heel of the vessel connected to the first input thereof, a heel angle transducer having its output connected to the second input of the first comparator having its control output connected to the input of the first switching unit, the first and second outputs of the first switching unit being connected to a pump of the vessel heeling system, the electric connection between the signal conditioner and the computer including an interface.

It is expedient that the system should include a timer having its control output connected to the first input of the second switching unit, for presetting time intervals of energization of the computer.

The system preferably further comprises a second comparator, a unit for presetting the vessel draft value connected to the first input of the second comparator having the control output of the signal conditioner connected to the second input thereof, the signal conditioner having its multichannel control input connected through the interface with the multichannel control output of the computer, the control output of the second comparator being connected to the second control input of the second switching unit.

For monitoring the longitudinal moment of deadweight, the system preferably comprises at least one sensor of mechanical strain induced in the hull of the vessel, situated amidships of the vessel, at least one sensor of the vessel hull temperature and a sensor of outboard water temperature, each one of said sensors being connected to its respective group of inputs of the signal conditioner, the computer being adapted to compute the longitudinal moment produced by deadweight forces from said sensors of mechanical strain in the hull of the vessel, the sensor of the vessel hull temperature, the sensor of outboard water temperature and the sensors monitoring the draft value of the vessel.

It is further expedient that the system should comprise sensors monitoring the vessel's supplies connected to their respective group of inputs of the signal conditioner, to have their output signals used by the computer for correcting the computed values of the metacentric height and trim of the vessel.

The disclosed system provides for stepping up the efficiency of operation of the vessel and also provides conditions for its trouble-free service, owing to a higher accuracy of computation of the metacentric height.

BRIEF DESCRIPTION OF THE DRAWINGS

The invention will be further described in connection with its embodiment, with reference being made to the appended drawings, wherein.

DESCRIPTION OF THE PREFERRED EMBODIMENT

Figure 1:
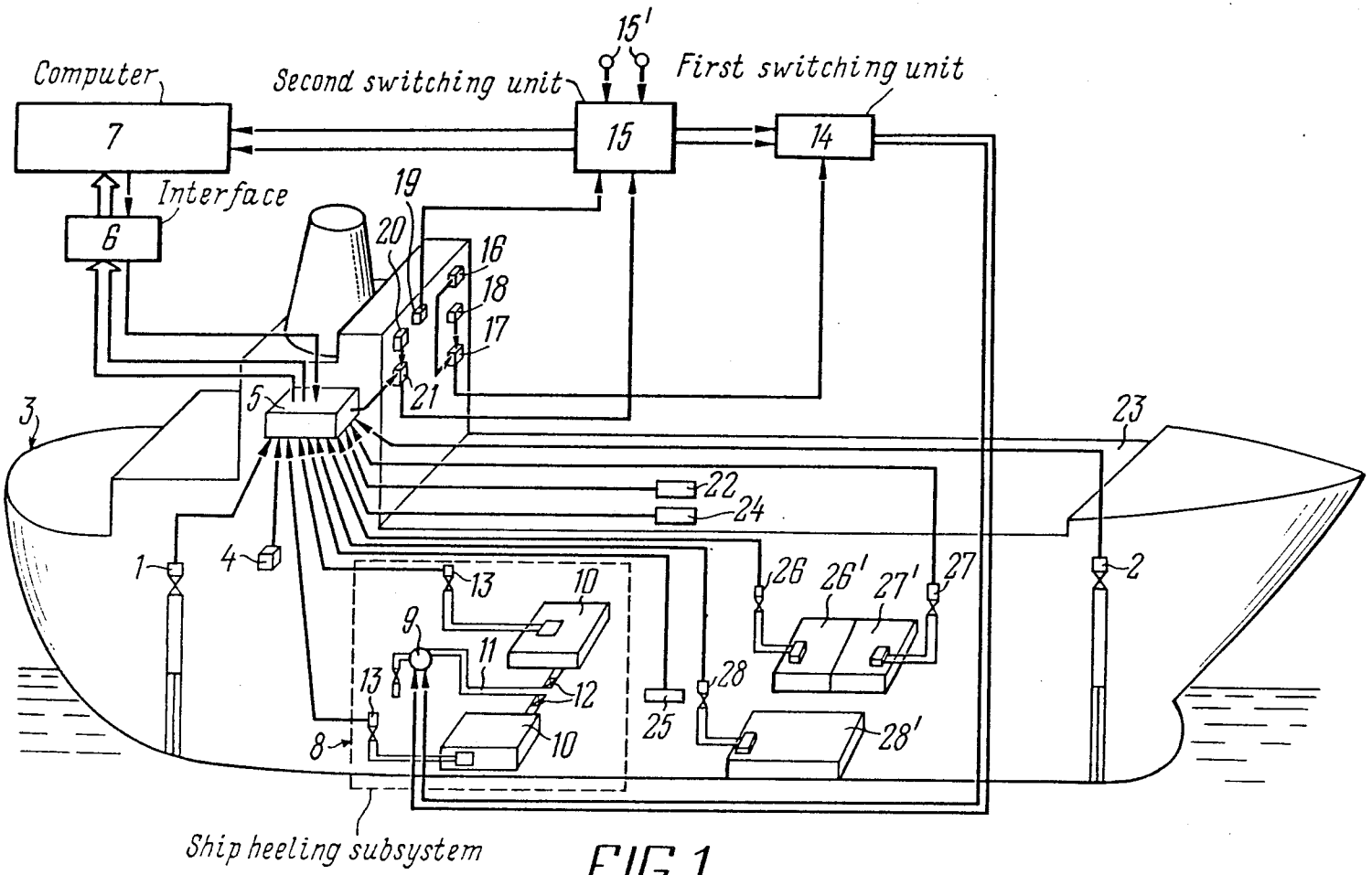
FIG. 1 illustrates schematically a system for automated monitoring of the trim and stability of a ship, embodying the invention.

Referring now in particular to the appended drawings, the system for automated monitoring of the trim and stability of a ship includes two sensors 1, 2 (FIG. 1) for monitoring the value of the draft of the ship 3, mounted aft and fore of the ship 3, and a heel angle sensor 4. The draft monitoring sensors 1 and 2 in the presently described embodiment are float-type level gauges. The heel angle sensor 4 can be a pendulum-type inclination meter. However, it is possible to use instead of a single pendulum-type inclination meter two similar sensors of the draft of the ship 3, situated at the opposite sides of the ship 3 at its broadest beam, e.g. of the same design as the draft sensors 1, 2. Then, the value of tg$\theta$ where $\theta$ is the angle of the heel of the ship 3 is determined as the ratio of the difference between the readings of the two sensors to the base length of their arrangement.

The draft sensors 1, 2 are connected to the first group of inputs of a signal conditioner 5, and the heel angle sensor 4 is connected to the second group of inputs of the signal conditioner 5 intended for converting dissimilar output signals of the respective sensors connected to it into signals susceptible to further handling and processing. The multichannel data output of the signal conditioner 5 is connected to the multichannel data input of a data input/output (I/O) interface 6 which supports the operation of the plurality of sensors with the computer 7 by time-divided interrogation of the sensors.

The computer 7 is intended to compute the values of the metacentric height "h", displacement "D", means draft "T", heel angle $\theta$ and trim angle $\phi$ of the ship 3.

The third group of inputs of the conditioner 5 has connected to it the first and second outputs of the heeling subsystem 8 of the ship 3, including a pump 9 and ballast tanks 10 communicating with the pump 9 via lines 11 with controllable valves 12. The tanks 10 incorporate liquid level indicators 1 3 sending their output signals to the third group of inputs of the signal conditioner 5.

The system further comprises a switching unit 14 for controlling the supply of power to the heeling subsystem 8 of the ship 3 and a switching unit 15 for controlling the energization of the computer 7 in either automatic or manual control mode, and also transmitting supply voltage to the switching unit 14 from power supply terminals 15' to which the first and second inputs of the switching unit 15 are connected.

In accordance with the invention, the automated monitoring system further comprises a unit 16 for presetting a value of the heel of the ship 3, and a signal comparator 17, the output of the unit 16 being connected to the first input of the signal comparator 17.

The other input of the comparator 17 has connected to it the output of a heel angle indicator 18. The output of the comparator 17 is connected to the control input of the switching unit 14 for controlling energization of the pump 9 of the heeling subsystem 8.

To monitor the value of "h" at predetermined time intervals, the system comprises a timer 19 connected to the input of the switching unit 15 and presetting the periodicity of energization of the computer 7 for measuring and computing the values of "h", "T", "D", $\theta$ and $\phi$.

The system also comprises a unit 20 for presetting a value of the draft of the ship 3 and a signal comparator 21 having the output of the unit 20 connected to its first input and the control output of the signal conditioner 5 connected to its second input, the output of the comparator 21 being connected to the second control input of the switching unit 15.

To provide for monitoring the longitudinal moment produced by deadweight forces, the ship 3 accommodates at least one sensor 22 of mechanical strain induced in the hull 23 of the ship 3. This at least one sensor 22 is situated at the amidships section of the ship 3, and the actual amount of such sensors 22 is dictated by the required accuracy of monitoring the strength of the hull 23 of the ship 3. Thus, it is deemed sufficient to have three sensors 22 spaced about the perimeter of the amidships section of the ship 3.

To complement the mechanical strain sensors 22, the ship 3 also accommodates a sensor 24 of temperature of the hull 23 of the ship 3, and a sensor 2 5 of outboard water temperature. The respective outputs of the sensors 22, 24 and 25 are connected to the fourth group of inputs of the signal conditioner 5 having its multichannel data output connected to the multichannel data input of the interface 6.

To correct a computed value of the metacentric height "h", the system includes ship supply sensors, e.g. a ballast monitoring sensor 26 measuring the level of the liquid in the ballast tank 26', a fuel supply sensor 27 measuring the fuel level in the fuel tank 27', a sensor 28 monitoring the supply of water for sanitary needs of the ship 3, measuring the water level in the tank 28'. The respective outputs of the sensors 26 to 28 are connected to the fifth group of inputs of the signal conditioner 5.

Figure 2:
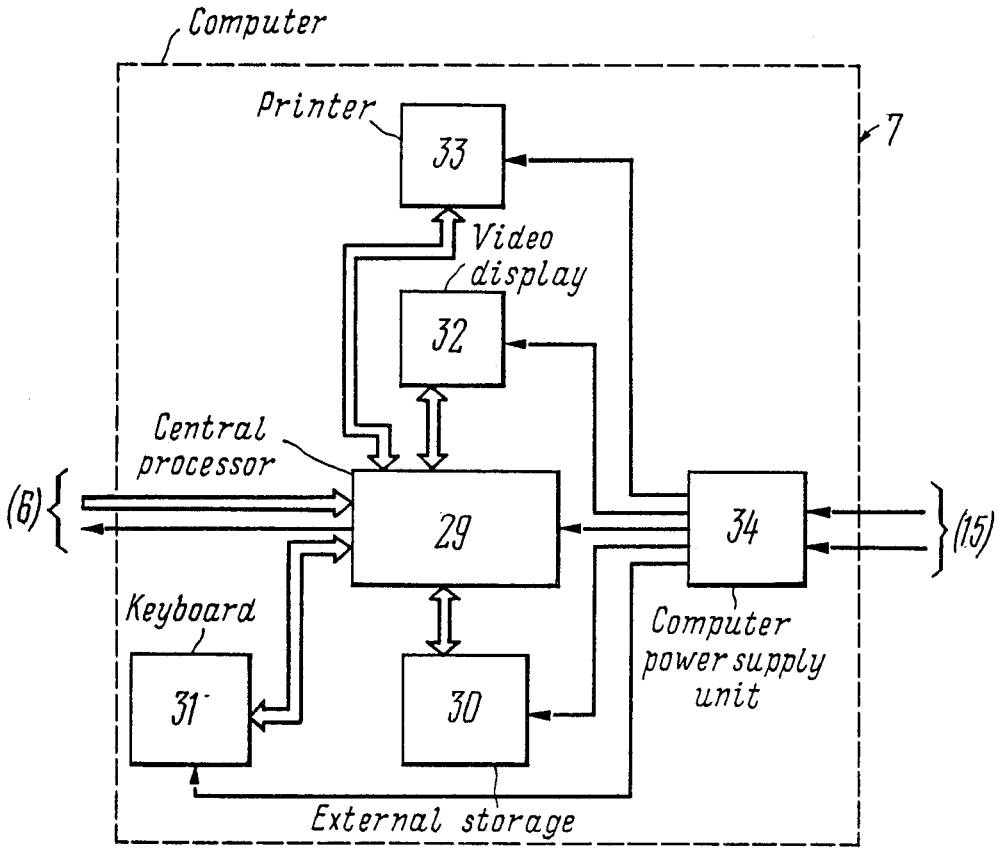
FIG. 2 is a block diagram of the computer in the system embodying the invention.

The computer 7 is preferably a control computer, e.g. built about an INTEL 8085 standard microprocessor. In any case, the use of a standard computer is advisable. A simplified functional block diagram of the computer 7 is illustrated in FIG. 2. The computer 7 comprises a processor 29, an external storage 30 connected with the processor 29, a manual data input keyboard 31 for entering information into the processor 29, a data video display screen 32, a data printout printer 33 and a power supply unit 34 of the computer 7 feeding its respective components, its inputs being connected to the outputs of the switching unit 15 and its respective outputs being connected to the processor 29, external storage 30, keyboard 31, display screen 32 and printer 33 for supplying them with required working voltage. The power supply unit 34 is of any suitable standard structure and forms an inherent part of a standard computer which is advisably used as the computer 7.

Figure 3:
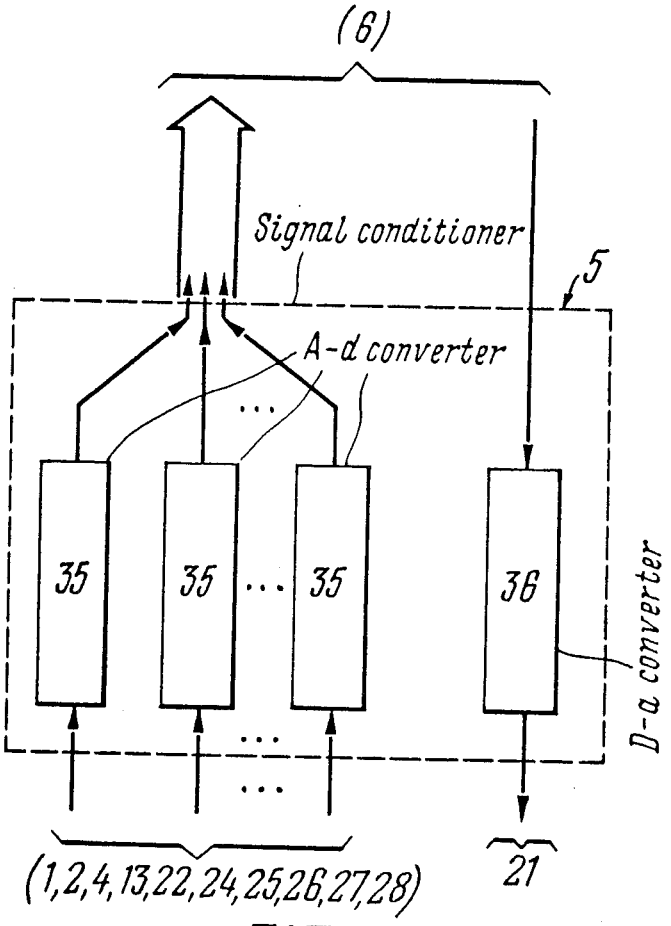
FIG. 3 is a functional block diagram of the signal conditioner in the system embodying the invention.

The signal conditioner 5 incorporates an array of analog-to-digital (a-d) converters 35 (FIG. 3) in a number equal to the number of the sensors connected to the conditioner 5. The a-d converters are preferably in the form of integrated circuits, e.g. AD571KD marketed by Analog Device or TDC 1014J marketed by Siemens.

The a-d converters 35 have their inputs connected to the respective sensors, and their outputs connected to the multichannel data input of the interface 6.

To control the comparator 21 a digital-to-analog (d-a) converter 36 is incorporated converting a digital control signal coming from the computer 7 via the interface 6 into an analog signal fed to the first input of the comparator 21. The d-a converter 36 can be based on standard microcircuits, e.g. TCA 730 marketed by ITT or AD7520 marketed by Analog Devices.

Figure 4:
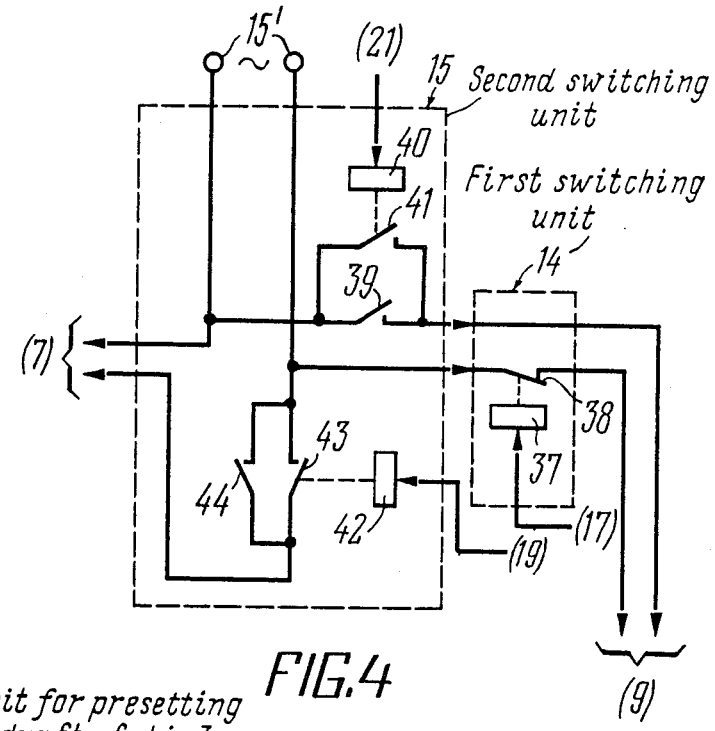
FIG. 4 is a circuit diagram of the first and second switching units in the system embodying the invention.

The switching unit 14 includes the coil 37 (FIG. 4) of a master relay with normally closed (n.c.) contacts 38. The movable contact of the n.c. contacts 38 serves as the second input of the switching unit 14 and their fixed contact is the second output of the switching unit 14. The coil 37 of the master relay 37 is connected to the output of the comparator 17.

The switching unit 15 includes a manual switch 39 whose fixed contact is the third output of the switching unit 15 and movable contact is connected to a power terminal 15', the coil 40 of a master relay with normally open (n.o.) contacts 41, and the coil 42 of a master relay with contacts 43 connected in parallel with a manual switch 44.

The coil 40 of the master relay is connected to the output of the comparator 21, and the coil 42 of the master relay is connected to the output of the timer 19. The first and second inputs of the switching unit 15 are connected to the power terminals 15'.

Figure 5:
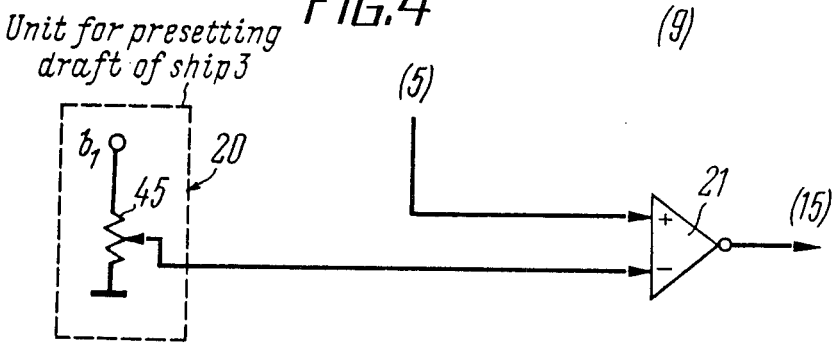
FIG. 5 is a functional block diagram of the unit for presetting a value of the draft of the ship and of the second comparator in the system embodying the invention.

The unit 20 for presetting a value of the draft of the ship 3 is preferably in the form of a potentiometer 45 (FIG. 5) whose scale is calibrated in values of the draft of the ship 3. The contact arm (wiper) of the potentiometer 45 is connected to the first input of the comparator 21 which can be of any suitable known structure.

Figure 6:
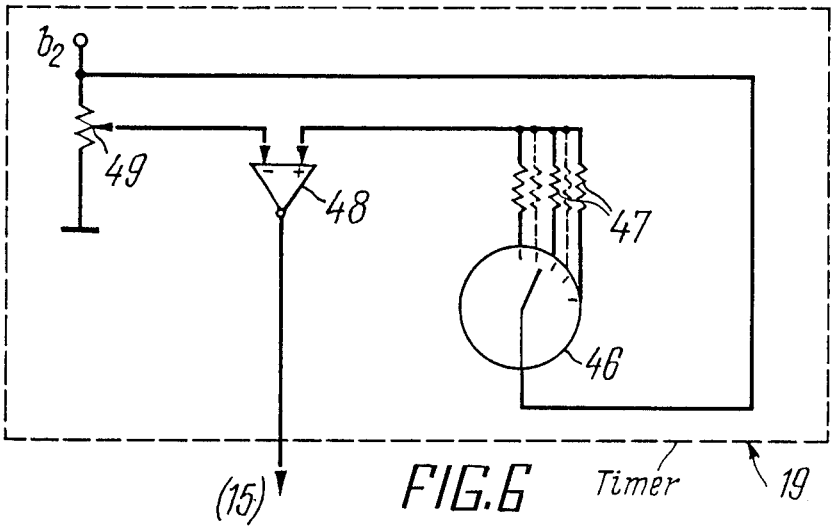
FIG. 6 is a circuit diagram of the timer in the system embodying the invention.

The timer 19 includes an independent clock 46 (FIG. 6) and an array of resistors 47 whose similar leads are connected to contacts provided on the divisions of the dial of the clock 46, a comparator 48 having its first input connected to similar other joined leads of the resistors 47, and a potentiometer 49 whose scale is calibrated in values corresponding to time intervals. The clock 46 and potentiometer 49 are connected to an independent power source (not shown).

Figure 7:
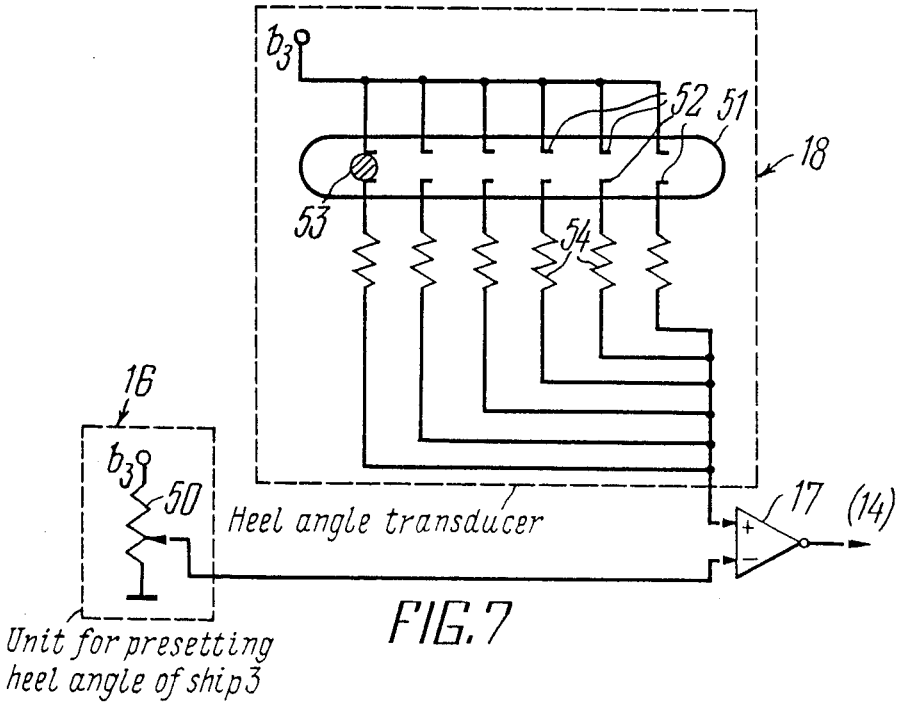
FIG. 7 is a circuit diagram of the heel angle transducer in the unit for presetting the heel value and of the first comparator in the system embodying the invention.

The unit 16 for presetting a value of the heel of the ship 3 includes a potentiometer 50 (FIG. 7) having its scale calibrated in degrees of the heel angle of the ship 3. The contact arm (wiper) of the potentiometer 50 is connected to the first input of a comparator 17 of any suitable known structure. The second input of the comparator 17 is connected to the output of the heel angle indicator 18. The indicator 18 in the presently described embodiment is a curving glass tube 51 sealed at both ends, having a series of pairs of contacts 52 soldered to its inner surface and a drop 53 of mercury adapted to roll among these contacts 52. Similar leads of the contacts 52 are joined and connected to an independent power supply source (not shown), while their other leads are connected to the first leads of the respective resistors 54 whose other outputs are joined and connected to the second input of the comparator 17.

The system for automated monitoring of the trim and stability of a ship operates, as follows. With the ship 3 (FIG. 1) either riding an anchor or moored at dockside, the navigator activates the computer 7 to determine the trim and stability of the ship 3. Data from the sensors 1, 2 monitoring the draft of the ship 3, from the sensor 4 of the heel angle and from the gauges 13 of the liquid level in the ballast tanks 10 of the ship heeling subsystem 8 come through the respective first, second and third groups of inputs into the signal conditioner 5 where the analog signals of these sensors and gauges are converted into digital form and fed via the data input/output interface 6 to the computer 7 where the values measured by the sensors 1, 2, 4 and gauges 13 are stored in the external storage of the computer 7 when the latter is activated.

To compute the metacentric height "h" of the ship 3 determining the stability, a ship heeling test has to be conducted. To this, the navigator operates the unit 16 to preset a value of the heel of the ship 3 suiting the situation (generally, 2°–3°). An analog electric signal coresponding to the preset heel angle of the ship 3 is fed to the first input of the comparator 17 having fed to its other input a signal from the heel angle indicator 18 representing the actual heel angle of the ship 3 as an absolute value. The comparator 18 compares the signals coming from the unit 16 and from the indicator 18. When the two signals have equal values, the comparator 17 generates a control signal at its output, fed to the control input of the switching unit 14.

Having preset the required heel angle of the ship 3 with the unit 16, the navigator energizes the pump 9 of the heeling subsystem 8 of the ship 3. The ballast pump 9 pumps outboard water via the line 11 to the respective one of the ballast tanks 10, and the ship 3 starts heeling to the side where the tank 10 into which outboard water is being pumped is situated. The pumping is maintained until the ship 3 heels to an angle preset with the unit 16. As this heel angle is attained, the signals coming to the two inputs of the comparator 17 become equal, and a control signal is fed to the switching unit 14 to cut off the voltage supply to the pump 9 of the ship heeling subsystem 8, so that pumping of outboard water is discontinued.

With the heeling test of the ship 3 completed, the data from the sensors 1, 2, 4 and gauges 13 are fed once again into the external storage of the computer 7.

The computer 7 processes these data supplied by the sensors and gauges to compute the value of the average draft of the ship 3:

$$T_3 = \tfrac{1}{2}(T_1 + T_2); \quad (1)$$

where $T_3$ is the value of the mean draft of the ship 3;

$T_1$ is the value of the draft of the ship 3 as measured by the draft sensor 1;

$T_2$ is the value of the draft of the ship 3 as measured by the draft sensor 2.

The computer 7 also computes the trim angle $\phi$ of the ship 3 from the following expression:

$$tg\phi = (T_1 + T_2)/L, \quad (2)$$

where L is the length of the ship 3 between the zones where the sensors 1 and 2 are mounted, the value of L being stored in the memory of the computer 7.

The computer 7 computes the value of the metacentric height "h" from the expression:

$$h = (57.3 \cdot M/\Delta\theta \cdot D) \quad (3)$$

where

D is the volume displacement of the ship 3, $\Delta\theta$ is the increment of the heel angle of the ship 3, M is the heeling moment.

The value of the displacement "D" of the ship 3 is computed from the expression:

$$D = S \cdot T_3, \quad (4)$$

where $T_3$ is the value of the mean draft of the ship 3;

S is the actual waterplane area, $M^2$.

The memory of the computer 7 stores the data from the appropriate source such as the "Captain's Data on Stability" Manual, e.g. a scale of tons per 1 cm of ship's draft, or the so-called "displacement curve". These data and the actual draft values of the ship 3 measured by the sensors 1, 2 are processed to compute the displacement "D" of the ship 3.

The value of the heeling moment M is computed from the data coming from the gauges 13 measuring the liquid levels in the ballast tanks 10 of the ship heeling subsystem 8.

The value of the increment $\Delta\theta$ of the heel angle is computed by the computer 7 from the following expression:

$$\Delta\theta=\theta_1-\theta_2, \quad (5)$$

where $\theta_1$ is the value of the heel angle before the heeling of the ship 3, as supplied by the sensor 4;

$\theta_2$ is the value of the heel angle after the heeling of the ship 3, supplied by the sensor 4.

The computed value of the metacentric height "h" of the ship 3 is displayed by the computer 7 on its display screen and printed out by the printer, for the information thus obtained to be used by the navigator in making a decision on either additionally loading the ship 3 or reballasting the ship 3, after which the navigator turns off the voltage supply to the computer 7.

The incorporation in the herein disclosed system of the unit 16, indicator 18 and comparator 17 connected with the switching unit 14 provides for substantially enhancing the accuracy of computation of the value of the metacentric height of the ship 3. This accuracy gain is due to the ship 3 being heeled to an angle preset by the navigator by a varying heeling moment depending on the actual value of the metacentric height "h" of the ship 3. This heeling moment is produced with the use of the common ballast tanks 10 being filled with outboard water, the level of filling of these tanks 10 being monitored by the gauges 13.

The procedure of determining the metacentric height "h" can be automatically repeated. To do this, the navigator presets the timing with the timer 19 (e.g. one-, two-, three- or four-hour intervals). As the time preset by the navigator lapses, the timer 19 generates a control signal fed to the first control input of the switching unit 15, so that supply voltage from the power terminals 15' is fed to the first and second inputs of the computer 7, and the heeling test of the ship 3 is automatically repeated.

It is also possible to determine the metacentric height of the ship 3 with the heeling test being carried out at a predetermined value of the mean draft of the ship 3 preset by the navigator. To do this, the navigator activates the computer 7 and presets the required draft value with the unit 20 for presetting a ship draft value. The output signal of the unit 20 is fed in an analog form to the first input of the comparator 21, and a signal representing the mean draft value $T_2$ of the ship 3 computed by the computer 7 is fed to the other input of the comparator 21.

The last-mentioned signal generated by the computer 7 in a digital form is fed via the interface 6 to the multichannel control input of the signal conditioner 5, to be converted into the analog form and fed by the control output of the signal conditioner 5 to the second input of the comparator 21. The latter compares the signals coming from the unit 20 and signal conditioner 5. When the two signals have equal values, the comparator 21 generates at its output a control signal fed to the second control input of the switching unit 15, whereby supply voltage is fed from the power terminals 15' to the unit 14, and then to the pump 9 of the ship heeling subsystem 8. The pump 9 pumps outboard water into one of the ballast tanks 10, and the heeling test is repeated.

The incorporation of the unit 19 connected with the switching unit 15, of the unit 20 and of the unit 21 also connected with the switching unit 15 provides for computing the value of the metacentric height "h" of the ship 3, determining the stability of the ship 3, either at predetermined intervals (e.g. every hour, or else every two, three or four hours), or else when the mean draft of the ship 3 attains a predetermined value (i.e. when the ship 3 is correspondingly loaded), which, in combination with a high accuracy of computation of values of the metacentric height "h" of the ship 3, creates conditions for its emergency-free operation.

To further provide for emergency-free and efficient operation of the ship 3, signals coming in an analog form from the sensor 22 of mechanical strain in the hull 23 of the ship 3, from the sensor 24 of temperature of the hull 23 (there can be several sensors 24 and these sensors can be in the form of thermocouples) and from the sensor 25 of outboard water temperature into the signal conditioner 5 are converted into digital form and fed via the interface 6 to the multichannel data input of the computer 7. The computer 7 uses the conditioned signals of the sensors 22, 24, 25 and previously computed data on the displacement "D" of the ship 3 (Expression 4) to compute resistance moments at different sections of the ship's hull, the bending moment of deadweight forces amidships, sag values, employing techniques generally known from the ship engineering theory.

Upon the ship 3 leaving the dockside, it is possible during a sea voyage to correct the previously obtained data on actual stability and trim of the ship 3, as these data change due to depletion of the water and fuel supplies. This procedure requires current data coming from the sensors 26 monitoring the amount of ballast (e.g. in the form of level gauges accommodated in the ballast tanks 26'), the sensors 27 monitoring the fuel supply (e.g. level gauges accommodated in the fuel tanks 27'), the sensors 28 monitoring the supply of water for sanitary needs, i.e. for drinking and washing (e.g. level gauges accommodated in the tanks 28'). Analog signals coming from these sensors into the signal conditioner 5 are converted to digital form and fed via the interface 6 to the multichannel data input of the computer 7 which performs necessary computations to correct the data obtained prior to the ship's departure, using appropriate formulas generally known in ship engineering (e.g. the load removal concept). Thus, it is possible to have the actual values of the ship's trim and stability throughout a ship voyage across the seas, which avoids dangerous errors in assessing these important variables on passage.

FIG. 2 of the appended drawings presents a block diagram of the computer 7. Its external storage 30 (a magnetic tape or magnetic disc unit) has recorded therein the successively computed values of the mean draft $T_3$, trim angle $\phi$ and metacentric height "h" of the ship 3, of the heeling moment "M" and displacement "D". Also captured in the storage 30 are approximated values of curves of the components of the ship's lines drawing plan, interpolation curves critical values of the metacentric height and bending moment of deadweight forces, other relevant constants of the ship 3. As signals come from the sensors and gauges of the system, the central processor 29 of the computer 7 uses all the pertinent data to compute the abovementioned parameters and variables and feeds out the computed data to the display screen 32 and printer 33, while the value of the mean draft $T_3$ of the ship 3 is fed to the multichannel control output of the computer 7, to be used for shaping a control signal at the control output of the signal conditioner 5.

The signal conditioner 5 (FIG. 3) converts analog signals coming from the sensors and gauges of the system into digital form in the a-d converters 35, and also converts digital signals coming from the computer 7 into an analog control signal in the d-a converter 36.

The switching units 15 (FIG. 4) and 14 control the supply of voltage from the power terminals 15' to the computer 7 and to the pump 9 of the heeling subsystem 8 of the ship 3. As the switch 44 in the unit 15 is manually turned on by the ship's navigator (the navigator turns this switch on and off at will), supply voltage from the power terminals 15' is fed to the power supply unit 34 (FIG. 2) of the computer 7. When the manual switch 39 (likewise operated by the navigator) is turned on, supply voltage is fed from the power terminals 15' (FIG. 4) via the respective power supply line to the pump 9 (FIG. 1) of the heeling subsystem 8 of the ship 3.

When a control signal is sent by the comparator 17 to the coil 37 (FIG. 4) of the master relay, the latter opens its n.c. contacts 38, and power supply to the pump 9 (FIG. 1) of the ship heeling subsystem 8 is cut off.

When a control signal comes from the timer 19 to the coil 42 (FIG. 4) of the master relay of the switching unit 15, the n.o. contacts 43 of this relay close, and power is supplied from the terminals 15' to the computer 7.

When a control signal is sent by the comparator 21 to the coil 40 of the master relay of the switching unit 15, the n.o. contacts 41 of this relay close, and voltage is supplied from the power terminals 15' to the pump 9 of the ship heeling subsystem 8.

The unit 20 (FIG. 5) for presetting a value of the draft of the ship 3, as it has been already mentioned, preferably incorporates a potentiometer 45 having its scale calibrated in ship draft values, its terminal $b_1$ being connected to the ship's d.c. supply mains. The comparator 21 is of the inverting-input type. When signals coming thereto from the signal conditioner 5 and unit 20 are equal, the comparator 21 generates at its output a control signal sent to the control input of the switching unit 15.

The timer 19 (FIG. 6) operates, as follows. Time intervals, e.g. one, two, three or four hours are preset by the navigator operating the potentiometer 49 having its scale calibrated in time intervals. The output signal of the potentiometer 49 is fed to the first input of the comparator 48, and a signal from the independently supplied clock 46 is fed to its other input. The arm of the clock 46 successively closes the contacts of the dial of the clock 46, so that supply voltage from terminal $b_2$ is fed via the circuit through the resistors 47 to the second input of the comparator 48 which is preferably of the inverting-input type. When the signals coming to the first and second inputs of the comparator 48 are equal, it generates at its output a control signal sent to the switching unit 15.

The heel angle indicator 18 (FIG. 7), the unit 16 for presetting the value of the heeling of the ship 3 and the comparator 17 are operated, as follows. When the ship heel angle varies, the drop of mercury 53 moves inside the sealed curving tube 51, successively shunting the pairs of contacts 52 soldered to the interior of the tube 51, each pair corresponding to a certain heel angle of the ship 3, so that supply voltage from terminal $b_3$ is fed via the mercury drop 53 and the respective resistor 54 corresponding to the shunted pair of contacts 52 to the first input of the comparator 17, with a signal from the unit 16 for presetting the heel angle of the ship 3 being fed to the other input of the comparator 17. The unit 16 preferably incorporates the potentiometer 50 having its scale calibrated in heel angle values, e.g. 1°, 2°, 3°, 4°. When the signals coming to the two inputs of the comparator 17 are equal, it generates at its output a control signal routed to the switching unit 14. The comparator 17 is preferably of the inverting-input type.

The terminals $b_1$, $b_2$ and $b_3$ are permanently connected to the ship's d.c. supply mains.

The disclosed system for automated monitoring of the trim and stability of a vessel or ship provides for enhancing the efficiency of the operation, e.g. of a ship by increasing the amount of pay cargo being carried and reducing the amount of extra ballast, as this system is operable for consistently monitoring the actual values influencing the trim and stability of the ship.

Today's widely employed calculation method of monitoring trim characteristics, even when performed with the aid of present-day computer hardware and software, is not free from errors arising, mainly, from the data entered on the coordinates of the cargo, particularly, related to its gravity centres and weight (mass) being but approximate. To compensate for an eventual error in calculating the trim and stability characteristics, a navigator more often than not introduces a safety margin by underloading the ship, refusing to have additional deck-mounted cargo and taking in extra ballast.

The disclosed system avoids such errors and thus enhances the efficiency of the ship's operation by stepping up its capacity to carry pay load (on the average, this increase is about 5 percent). If additional cargo is not available, the system avoids the carrying of extra ballast, thus increasing the ship's speed and reducing fuel consumption by up to 3 percent.

Thus, the employment of the herein disclosed system for automated monitoring of the trim and stability of a vessel offers safer sailing and higher efficiency of the operation of ships and vessels of various kinds.

What is claimed is:

1. A system for automated monitoring of the trim and stability of a vessel having a hull, a bow defining the fore direction and a stern defining the aft direction, comprising:

at least two draft value sensors monitoring the value of the draft of the vessel, mounted, respectively, fore and aft of said vessel, each of said at least two sensors having an output;

at least one heel angle sensor for monitoring heel angle of the vessel, said at least one sensor of the heel angle of the vessel having an output;

a vessel heeling subsystem adapted to produce a vessel heeling moment, said vessel heeling subsystem having first and second inputs and first and second outputs which provide signals representative of the degree of heeling of the vessel for obtaining information as to when the inclining moment of a ship is determined;

a computer adapted to compute the value of the metacentric height characterizing the stability of the vessel, based on data supplied by said draft value and heel angle sensors and data received from said vessel heeling subsystem, said computer having first and second inputs and a multichannel data input;

a signal conditioner adapted to condition dissimilar output signals of all said sensors into signals susceptible to processing in said computer, said signal conditioner having first, second and third groups of inputs and a multichannel data output, said outputs of said at least two draft value sensors being connected to said first group of inputs of said signal conditioner, said output of said at lease one heel angle sensor being connected to said second group of inputs of said signal conditioner, and said first and second outputs of said vessel heeling subsystem being connected to said third group of inputs of said signal conditoner;

an interface, for input and output of data into/from said computer, said interface being adapted to support simultaneous operation of all said sensors with said computer by dividing in time the process of interrogation of all said sensors, said interface having a multichannel data input and a multichannel data output, said multichannel data input of said interface being connected to said multichannel data output of said signal conditioner, and said multichannel data output of said interface being connected to said multichannel data input of said computer;

a unit for presetting the value of a vessel heel angle, operable for presetting in the course of a vessel heeling test a value of the vessel heeling angle required for evaluating the metacentric height of the vessel, said unit having an output;

a heel angle indicator having an output;

a first comparator, having a first input, a second input and an output, said first input of said first comparator being connected to said output of said heel angle indicator, and said second input of said first comparator being connected to said output of said unit for presetting the value of the vessel heeling angle;

a first switching unit adapted to connect said vessel heeling subsystem to supply voltage and to disconnect said vessel heeling system from supply voltage in response to a signal from said first comparator, said first switching unit having first and second inputs and a control input, and first and second outputs, said control input of said first switching unit being connected to said output of said first comparator, said first and second outputs of said first switching unit being connected to said first and second inputs of said vessel heeling subsystem;

voltage supply terminal means;

a second switching unit adapted to feed supply voltage to said computer under manual control and also to transmit supply voltage from said voltage supply terminal means to said first switching unit, said second switching unit having first and second inputs, first, second, third and fourth outputs, said first and second outputs of said second switching unit being connected to said first and second inputs of said computer, said third and fourth outputs of said second switching unit being connected to said first and second inputs of said first switching unit, and said first and second inputs of said second switching unit being connected to said voltage supply terminal means.

2. A system as set forth in claim 1, further comprising:

timer means adapted to preset the time of automatic energization of said computer for performing the process of evaluation of the metacentric height of the vessel, said timer means having a control output, said second switching unit having a first control input, and said timer means having a control output connected to said first control input of said second switching unit.

3. A system as set forth in claim 1, wherein:

said computer has a first multichannel control output adapted to provide a control signal from data representative of a mean draft of the vessel, said multichannel control output of said computer being connected through said interface to said multichannel control input of said signal conditioner, for conditioning a control signal coming from said computer into an analog signal for controlling said vessel heeling subsystem, said signal conditioner having an analog control output, said second switching unit having a second control input; and further comprising a unit for presetting a value of the draft of the vessel, having an output; a second comparator of signals received, respectively, from said unit for presetting a value of the draft of the vessel and from said signal conditioner, said second comparator having first and second inputs and an output, said first input of said second comparator being connected to said output of said unit for presetting a value of the draft of the vessel, said second input of said second comparator being connected to said control output of said signal conditioner, and said output of said second comparator being connected to said second control input of said second switching unit.

4. A system as set forth in claim 1, further comprising:

at least one mechanical strain sensor for sensing the mechanical strain induced in said hull of the vessel, situated at the amidships section of said hull of the vessel, said at least one mechanical strain sensor having an output;

at least one hull temperature sensor for sensing the temperature of said hull of the vessel having an output;

a water temperature sensor for sensing the outboard water temperature having an output, said signal conditioner having a fourth group of inputs, said respective outputs of said at least one mechanical strain sensor, of said at least one temperature sensor of said hull and of said outboard water temperature sensor being connected to said fourth group of inputs of said signal conditioner, said computer being adapted to compute the longitudinal moment produced by dead weight forces from data supplied by said mechanical strain sensor, said temperature sensor of said hull, said outboard water temperature sensor and said draft value sensors.

5. A system as set forth in claim 1, further comprising:

supplies sensor means for monitoring at least the vessel's fuel and water supplies and having outputs, said computer being adapted to correct the values of the metacentric height and trim of the vessel by data supplied by said supplies sensor means, said signal conditioner having a fifth group of inputs, and said outputs of said supplies sensor means being connected to said fifth group of inputs of said signal conditoner.

6. A system for automated monitoring of the trim and stability of a vessel having a hull, a bow defining the fore direction and a stern defining the aft direction, comprising:

at least two draft value sensors for monitoring the value of the draft of the vessel, situated fore and aft of the vessel, each one of said at least two draft value sensors having an output;

at least one heel angle sensor for monitoring the heel angle of the vessel, having an output;

at least one mechanical strain sensor for monitoring the mechanical strain induced in said hull of the vessel, situated at the amidships section of said hull of the vessel, having an output;

a hull temperature sensor for monitoring temperature of said hull of the vessel, having an output;

a water temperature sensor of outboard water temperature, having an output;

a plurality of supplies sensors for monitoring at least the vessel's fuel and water supplies, each having an output;

a vessel heeling subsystem adapted to perform a heeling test with the vessel, said subsystem having first and second inputs and first and second outputs which provide signals representative of the degree of heeling of the vessel;

a computer adapted to perform computations concerned with the seagoing and strength characteristics of the vessel from data supplied by all said sensors and from data on the vessel's parameters entered in the memory of said computer, namely, to compute the metacentric height of the vessel determining its stability, from data supplied by said draft value sensors and said heel angle sensor and from data supplied by said vessel heeling subsystem; to compute the displacement and trim of the vessel from data supplied by said draft sensors and said heel angle sensor; to correct the computed value of the metacentric height of the vessel by data supplied by said supplies sensors; to compute the longitudinal moment induced by dead weight forces from data supplied by said mechanical strain sensor, said hull temperature sensor, said outboard water temperature sensor and said draft value sensors;

a signal conditioner having first, second, third, fourth and fifth groups of inputs, said first group of inputs of said signal conditioner being connected to the respective outputs of said at least two draft value sensors, said second group of inputs of said signal conditioner being connected to said output of said at least one heel angle sensor, said third group of inputs of said signal conditioner being connected to said first and second outputs of said vessel heeling subsystem, said fourth group of inputs of said signal conditioner being connected, respectively, to said output of said at least one mechanical strain sensor, to said output of said hull temperature sensor and said output of said water temperature sensor, said fifth group of inputs of said signal conditioner being connected to said outputs of said supplies sensors, said signal conditioner having a multichannel data output and a multichannel control input;

an interface for input and output of data into/from said computer, adapted to support operation of all said sensors with said computer by dividing in time the process of interrogation of all said sensors, said computer having first and second inputs; a multichannel data input, a multichannel data output, a multichannel control input and a multichannel control output, said multichannel data input of said computer being connected through said interface to said multichannel data output of said signal conditioner, said multichannel control output of said computer being connected through said interface to said multichannel control input of said signal conditioner;

a unit for presetting a value of the vessel heel angle, operable in the course of a vessel heeling test for presetting a value of the vessel heeling angle required for evaluating the metacentric height of the vessel, said unit having an output;

a heel angle indicator having an output;

a first comparator having first and second inputs and an output; said first input being connected to said output of said heel angle indicator, and second input being connected to said output of said unit for presetting the vessel heel angle;

a first switching unit adapted to connect said vessel heeling subsystem to a supply voltage and to disconnect said vessel heeling subsystem from said supply voltage in response to a signal from said first comparator, said first switching unit having first and second inputs and a control input and first and second outputs, said control input of said first switching unit being connected to said output of said first comparator, said first and second outputs of said first switching unit being connected to said first and second inputs of said vessel heeling subsystem;

voltage supply terminal means;

a second switching unit adapted to feed supply voltage to said computer under manual control and also to transmit supply voltage from said voltage supply terminal means to said first switching unit, said second switching unit having first, second, third and fourth outputs, first and second inputs, first and second control inputs;

said first and second outputs of said second switching unit being connected to said first and second inputs of said computer, said third and fourth outputs of said second switching unit being connected to said first and second inputs of said first switching unit, said first and second inputs of said second switching unit being connected to said voltage supply terminal means;

a unit for presetting a value of the draft of the vessel having an output;

a second comparator of signals coming from said unit for presetting a value of the draft of the vessel and from said signal conditioner, having first and second inputs and an output, said first input of said second comparator being connected to said output of said unit for presetting a value of the draft of the vessel and said second input of said second comparator being connected to said control output of said signal conditioner, said output of said second comparator being connected to said second control input of said second switching unit;

timer means adapted to preset time intervals of energization of said computer for performing the operation of measurement and computation of the metacentric height, trim and displacement of the vessel, said timer means having an output connected to said first control input of said second switching unit.

* * * * *